US007723656B1

(12) United States Patent
Angelos

(10) Patent No.: US 7,723,656 B1
(45) Date of Patent: May 25, 2010

(54) MICROWAVEABLE FOOD PACKAGE

(75) Inventor: Theros Bill Angelos, Reno, NV (US)

(73) Assignee: Sierra Packaging and Converting, LLC, Sparks, NV (US)

( * ) Notice: Subject to any disclaimer, the term of this patent is extended or adjusted under 35 U.S.C. 154(b) by 448 days.

(21) Appl. No.: 11/615,476

(22) Filed: Dec. 22, 2006

(51) Int. Cl.
*H05B 6/80* (2006.01)

(52) U.S. Cl. ..... 219/725

(58) Field of Classification Search ..... 219/725, 219/726–735
See application file for complete search history.

(56) References Cited

U.S. PATENT DOCUMENTS 4,077,588 A * 3/1978 Hurst ..... 244/31
6,610,391 B2 * 8/2003 Molee ..... 428/212
7,141,034 B2 * 11/2006 Eppstein et al. ..... 604/22

* cited by examiner

*Primary Examiner*—Daniel L Robinson
(74) *Attorney, Agent, or Firm*—Lewis & Roca LLP

(57) ABSTRACT

A microwavable food package is disclosed, comprising a packaging sheet including first and second column of apertures, the apertures between 100 microns and 800 microns in diameter; and a central seal, the central seal joining a first edge of the packaging sheet to a second edge of the packaging sheet, the central seal running longitudinally along the length of the food package, wherein the first column of apertures is on one side of the central seal and the second column of apertures is on the other side of the central seal.

22 Claims, 1 Drawing Sheet

MICROWAVEABLE FOOD PACKAGE

FIELD

The present invention relates broadly to food packaging. Specifically, the present invention relates to microwaveable food packaging that vents while cooking in a microwave oven.

BACKGROUND

Microwave ovens are present in nearly every kitchen. Supermarkets now sell a vast assortment of microwaveable food products. However, in many microwaveable products, the heat generated inside the food packaging needs to be handled carefully to prevent injury and improper cooking of the food contained within the microwaveable package.

Prior approaches to solving this problem are insufficient. Some packaging requires the user to cut open a portion of a plastic pouch. Usually this is only at one end of the package, and done simply to prevent a pressure buildup within the plastic pouch. This does not allow proper airflow in many instances, and in some cases can allow food to spill out of the package during cooking or handling. In another approach, a clip is attached to the pouch after it is opened to close the package yet allow the package to vent, but some users will fail to attach the clip properly, and leakage may still occur.

Thus, there still remains a heartfelt need to for a microwaveable food package that incorporates improved venting.

SUMMARY

The present invention provides a microwaveable food package that incorporates very small perforations made by a laser on portions of a plastic pouch. In an embodiment, these perforations are on opposite sides of one panel of a plastic pouch in a strip pattern. The perforations are quite small and in some cases unnoticeable to the human eye, and do not require the user to slit open the pouch or open any portion of the pouch. In the case of frozen food, the perforations can be oriented on one side of the pouch, so that the pouch can be laid on a plate or other surface inside the microwave oven with the perforations facing up, so that no food leaks out of the pouch as the pouch cooks. One main benefit realized from the present invention is a more uniform venting of the food while it cooks, so that the chance of scalding the user or improperly cooking the food is greatly reduced.

DETAILED DESCRIPTION

Figure 1:
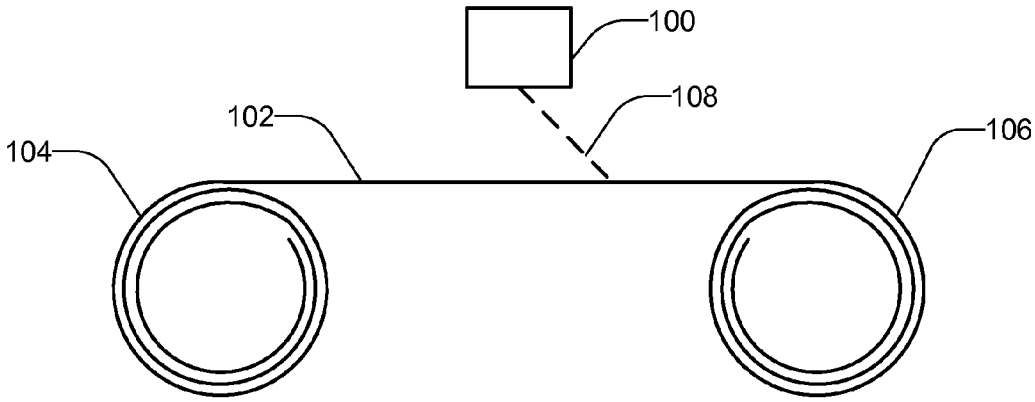
FIG. 1 illustrates the formation of apertures in food packaging by a laser.

Directing attention to FIG. 1, laser 100 is positioned above packaging sheet 102, which is fed from supply roller 104 to collection roller 106. Laser beam 108 is directed to packaging sheet 102, and perforates packaging sheet 102 as it passes beneath laser 100. In the preferred embodiment, laser 100 is comprised of a Laser Processing Module 100, available from LasX Industries, Inc., of White Bear Lake, Minn. Laser 100 can be configured to form apertures in a wide variety of patterns on packaging sheet 102, for example to avoid labeling or packaging graphics, or to intersperse apertures different areas of packaging sheet 102 so they are less noticeable to the human eye, or to meet oxygen flow requirements of the food contained with the food package. In an embodiment, apertures can be formed in columns of apertures running the length of packaging sheet 102 to form a vent. In an embodiment, columns can be spaced two inches apart, or on opposite sides of a seal (such as a lap seal or a fin seal) that often is formed in the center of one panel of a food package. Apertures are formed with a diameter ranging from approximately 100 microns to approximately 800 microns, preferably at 400 microns in diameter. The size of the hole may depend on several different factors, such as the size of the food package, the required oxygen transfer, or asthetics.

Packaging sheet 102 may be polyester, oriented polypropylyn, cast, polypropylyn, nylon, mylar, polyethylene, other suitable material. Packaging sheet may also comprise several layers of these materials depending on packaging needs, as known to those skilled in the art.

Figure 2:
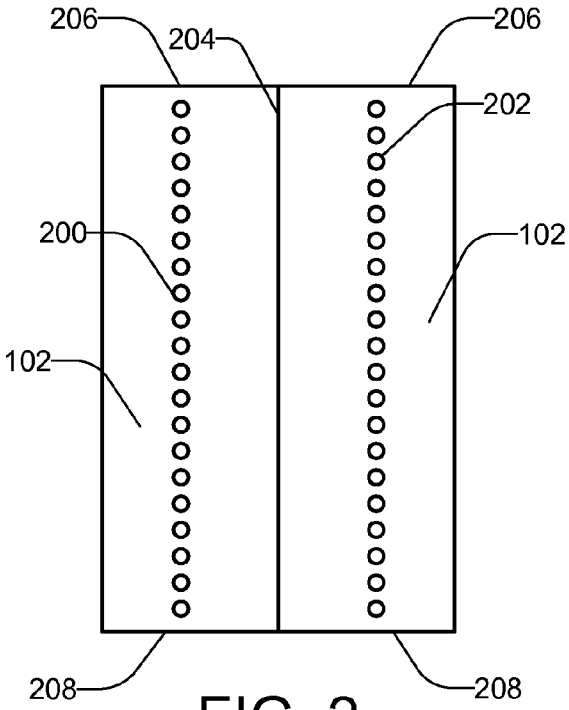
FIG. 2 illustrates an embodiment of aperture configuration in the packaging sheet.

Directing attention to FIG. 2, a segment of packaging sheet 102 is shown. Packaging sheet 102 contains aperture column 200 and aperture column 202, which are oriented on opposite sides of seal 204. Seal 204 is generally formed by affixing two edges of packaging sheet 102, in either a lap seal or fin seal as described above. By placing columns 200, 202 at opposite sides of packaging sheet 102 and sealing ends 206, 208, a sealed food pouch can be formed around a food product to be microwaved, thus providing improved oxygen transfer to the food product as well as a safer food package that poses less threat of scalding a user upon removal from the microwave oven.

Figure 3:
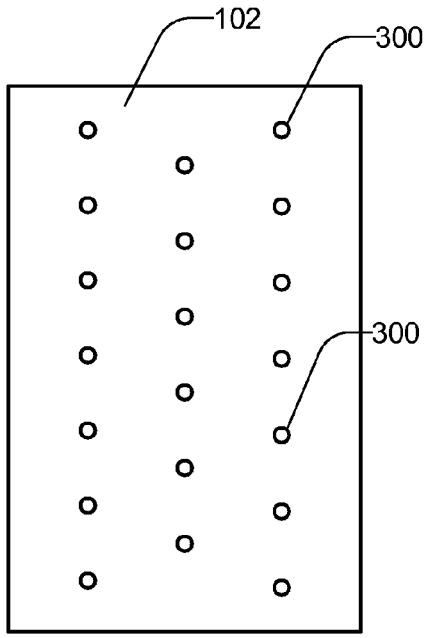
FIG. 3 illustrates an alternative embodiment of aperture configuration in the packaging sheet.

Directing attention to FIG. 3, apertures 300 can be interspersed throughout the packaging sheet 102, and have the same diameter as described above.

While a microwaveable food package has been described and illustrated in detail, it is to be understood that many changes and modifications can be made to various embodiments of the present invention without departing from the spirit thereof.

What is claimed is:

1. A microwavable food package, comprising:

a packaging sheet including first and second column of apertures, the apertures between 100 microns and 800 microns in diameter; and a central seal, the central seal joining a first edge of the packaging sheet to a second opposite edge of the packaging sheet, the central seal running longitudinally along the length of the food package, wherein the first column of apertures is on one side of the central seal and the second column of apertures is on the other side of the central seal.

2. The microwavable food package of claim 1, wherein apertures in the first column are separated by a distance of two inches.

3. The microwavable food package of claim 1, wherein apertures in the second column are separated by a distance of two inches.

4. The microwavable food package of claim 1, wherein the central seal comprises a lap seal.

5. The microwavable food package of claim 1, wherein the central seal comprises a fin seal.

6. The microwavable food package of claim 1, wherein the packaging sheet comprises oriented polypropylyn.

7. The microwavable food package of claim 1, wherein the packaging sheet comprises cast polypropylyn.

8. The microwavable food package of claim 1, wherein the packaging sheet comprises nylon.

9. The microwavable food package of claim 1, wherein the packaging sheet comprises mylar.

10. The microwavable food package of claim 1, wherein the packaging sheet comprises polyethylene.

11. The microwaveable food package of claim 1, wherein the packaging sheet comprises multiple layers.

12. The microwavable food package of claim 1, wherein apertures in the first column are separated by a distance of two inches.

13. The microwavable food package of claim 1, wherein apertures in the second column are separated by a distance of two inches.

14. The microwavable food package of claim 1, wherein the central seal comprises a lap seal.

15. The microwavable food package of claim 1, wherein the central seal comprises a fin seal.

16. The microwavable food package of claim 1, wherein the packaging sheet comprises oriented polypropylyn.

17. The microwavable food package of claim 1, wherein the packaging sheet comprises cast polypropylyn.

18. The microwavable food package of claim 1, wherein the packaging sheet comprises nylon.

19. The microwavable food package of claim 1, wherein the packaging sheet comprises mylar.

20. The microwavable food package of claim 1, wherein the packaging sheet comprises polyethylene.

21. The microwaveable food package of claim 1, wherein the packaging sheet comprises multiple layers.

22. A microwavable food package, comprising:

a packaging sheet including a plurality of apertures, the apertures between 100 microns and 800 microns in diameter; and a central seal, the central seal joining a first edge of the packaging sheet to a second edge of the packaging sheet opposite the first edge, the central seal running longitudinally along the length of the food package, wherein the plurality of apertures are oriented on both sides of the central seal.

* * * * *